US006257852B1

(12) United States Patent
Tarng et al.

(10) Patent No.: US 6,257,852 B1
(45) Date of Patent: Jul. 10, 2001

(54) BALANCING STRUCTURE OF AXIAL SUBMISSION DEVICE FOR SCROLL COMPRESSOR

(75) Inventors: Guang-Der Tarng, Hsin Chu Hsien; Lung-Tsai Chang, Hsin Chu, both of (TW)

(73) Assignee: Rechi Precision Co., Ltd., Tao Yuan Hsien (TW)

( * ) Notice: Subject to any disclaimer, the term of this patent is extended or adjusted under 35 U.S.C. 154(b) by 0 days.

(21) Appl. No.: 09/455,480

(22) Filed: Dec. 6, 1999

(51) Int. Cl.[7] ..... F01C 1/02
(52) U.S. Cl. ..... 418/55.5; 418/57
(58) Field of Search ..... 418/55.5, 57

(56) References Cited

U.S. PATENT DOCUMENTS 5,192,202 * 3/1993 Lee ..... 418/55.5
5,435,707 * 7/1995 Hirano et al. ..... 418/55.5
5,447,418 * 9/1995 Takeda et al. ..... 418/55.5
5,474,433 * 12/1995 Chang et al. ..... 418/57
5,487,653 * 1/1996 Lee ..... 418/55.5
5,494,422 * 2/1996 Ukai et al. ..... 418/55.1
6,056,523 * 5/2000 Won et al. ..... 418/57

FOREIGN PATENT DOCUMENTS 5-149266 * 6/1993 (JP) ..... 418/57
6-026470 * 1/1994 (JP) ..... 418/55.5
6-173864 * 6/1994 (JP) ..... 418/55.5

* cited by examiner

*Primary Examiner*—Thomas Denion
*Assistant Examiner*—Theresa Trieu
(74) *Attorney, Agent, or Firm*—Rosenberg, Klein & Lee

(57) ABSTRACT

The present invention proposes a balance structure of axial submission device for a scroll compressor. The present invention is characterized in that narrower cross section forms on the isolating block partitioning high pressure from low pressure in a scroll compressor such that the direction toward the stationary scroll of low pressure side has larger direct back pressure. Or more than one balance rooms are installed on the isolating block toward the back of the stationary scroll, a first resilient member is placed in the balance room, and the resilient member is lapped on the back of the stationary scroll. More than one anti-pressure rooms can also be installed on the orbiting scroll, and a second resilient member is placed in the anti-pressure room to provide slightly larger pressure for the second resilient member than pressure of the first resilient member when the orbiting scroll starts to rotate.

1 Claim, 10 Drawing Sheets

BALANCING STRUCTURE OF AXIAL SUBMISSION DEVICE FOR SCROLL COMPRESSOR

FIELD OF THE INVENTION

The present invention relates to a balancing structure of axial submission device for a scroll compressor and, more particularly, to a sealing structure that is installed on an isolating block for isolating high pressure from low pressure, and presses and holds a stationary scroll more steadily.

BACKGROUND OF THE INVENTION

As shown in FIG. 7, a scroll compressor in prior art comprises a stationary scroll 11, an orbiting scroll 10, and an isolating member 12. The inner side of the stationary scroll 11 has a predetermined number of spiral scroll plates. The stationary scroll 11 has a through discharge port 111 at the center thereof. The orbiting scroll 10 has a predetermined number of projecting spiral scroll plates to be assembled with the stationary scroll 11. The scroll plates form a plurality of compression rooms between the two scrolls. The orbiting scroll 10 is driven (by an eccentric shaft connected to a motor) to orbit the stationary scroll 11 but not to rotate on its axis such that working fluid is led into the compression rooms, compressed from low pressure through middle pressure to high pressure, and discharged at high-pressure state via the discharge port 111 of the stationary scroll 11. The isolating member 12 is fixed in a shell 1 of the scroll compressor and partitions the shell 1 into a high-pressure chamber 2 and a low-pressure chamber 3. A through hole 122 is disposed at the center of the isolating member 12 to connect the two chambers 2 and 3. A predetermined number of back pressure rooms 123 near the low-pressure chamber 3 are installed at positions at the same distance from the axis of the through hole 122. The stationary scroll 11 is located in the low-pressure chamber 3. The projecting edge of the discharge port 111 at the back of the stationary scroll 11 forms a tubular neck 112. The neck 112 is lagged in the through hole 122 of the isolating member 12 and can make a little motion along the axis of the through hole 112. A sealing ring 125 of back pressure mechanism and a resilient member 126 are installed in the neck 112. The sealing ring 125 presses on the resilient member 126 to build back pressure. An anti-leakage member 124 is installed between the outer surface of the sealing ring 125 and the inner surface of the neck 112 to prevent high-pressure working fluid of the discharge port 111 from leaking into the low-pressure chamber 3. A predetermined number of pressing members 13 are respectively accommodated in each back pressure room 123 to be lapped on the back 113 of the stationary scroll 11. An anti-leakage member 114 is installed between each pressing member 13 and each back pressure room 123. When the stationary scroll 11 and the orbiting scroll 10 are engaged, compressed working fluid generated therein is led into the back pressure rooms 123 to drive each pressing member to stick to the back 113 of the stationary scroll 11 such that the stationary scroll 11 sticks tightly to the orbiting scroll 10. Therefore, when the orbiting scroll orbits the stationary scroll 11, the two scrolls are tightly joined in the axial direction to prevent compressed working fluid in each compression room from leaking out.

As shown in FIGS. 6*a* and 6*b*, the pressing member 13 is a bolt of cylindrical shape 13*b* or of cylindrical cup shape 13*a*. In the prior art, to maintain compression stability and balance of the isolating member 12, th pressing member 13 must be evenly arranged at least every 120 degrees. Three back pressure rooms require three pressing members (also called axial submission bolts) and three corresponding anti-leakage members. If there are more back pressure rooms, more pressing members and anti-leakage members are needed such that the assembly process becomes more complex and the products cost thereof becomes higher. As shown in FIG. 9, a pressing member of annular groove shape 14*a* or annular shape 146 (both shown in FIGS. 8*a* and 8*b*) have been proposed in the prior art for use with a corresponding back pressure room of annular shape. However, an annular projecting edge 115 must be installed on the back of the stationary scroll 11 to stick to each pressing member 13 or 14*a*, 14*b*. Process complexity and production cost are thus increased. As shown in FIG. 10, a guide hole 116 of the tubular neck 112 of the stationary scroll 11 and a connection hole 121 disposed in the isolating member 12 have been proposed such that the compression room and the back pressure room 123 are connected. However, process complexity is increased. Also, inequality of pressure in the compression room may result in imbalance of the pressing member such that noise easily arises, abrasion of components increases, and thus lifetime is reduced.

SUMMARY AND OBJECTS OF THE PRESENT INVENTION

The primary object of the present invention is to provide a balancing structure of axial submission device for a scroll compressor such that balanced pressing and supporting of the isolating block to the stationary scroll can be achieved via simple process. Thereby process complexity, number of components, and production cost are all reduced while high accuracy of pressing and supporting function can be maintained.

The present invention is characterized in that narrower cross section forms on the isolating block partitioning high pressure from low pressure in a scroll compressor such that the direction toward the stationary scroll of low pressure side has larger direct back pressure. Or at least a balance room is installed on the isolating block toward the back of the stationary scroll, a first resilient member is placed in the balance room, and the resilient member is lapped on the back of the stationary scroll. Furthermore, at least an anti-pressure room can be installed on the orbiting scroll, and a second resilient member is placed in the anti-pressure room to provide slightly larger pressure for the second resilient member than pressure of the first resilient member when the orbiting scroll starts to rotate.

The various objects and advantages of the present invention will be more readily understood from the following detailed description when read in conjunction with the appended drawings, in which:

DETAILED DESCRIPTION OF THE PREFERRED EMBODIMENTS

Figure 1:
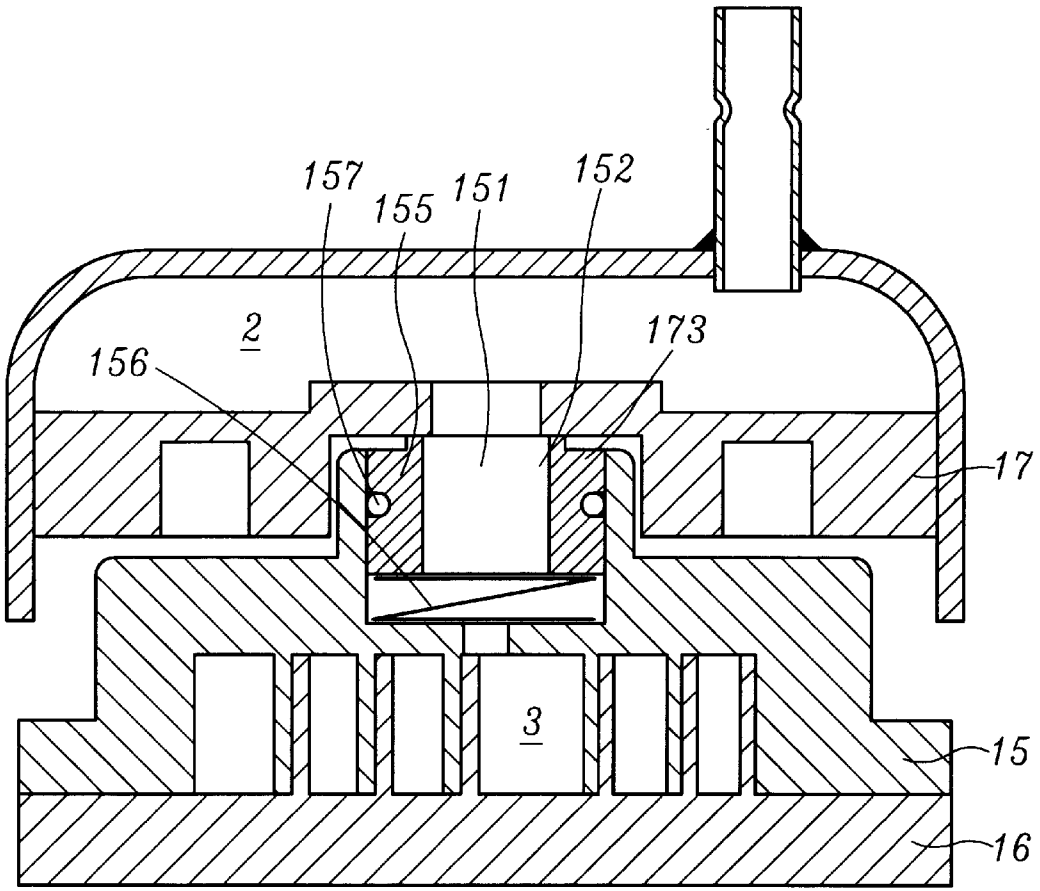
FIG. 1 is a cross-sectional view according to a first embodiment of the present invention.

As shown in FIGS. 1 to 5, a balance structure of axial submission device for a scroll compressor according to the present invention comprises a stationary scroll 15, an orbiting scroll 16, and an isolating block 17. The stationary scroll 15 has a through discharge port 151 at the center thereof and a plurality of spiral scroll plates. The orbiting scroll 16 has a plurality of projecting spiral scroll plates to be lapped in the stationary scroll 15. The scroll plates form a plurality of compression rooms between the two scrolls. The orbiting scroll 16 is driven (by an eccentric shaft connected to a motor) to orbit the stationary scroll 15 but not to rotate on its axis such that working fluid is led into the compression rooms, compressed from low pressure to high pressure, and discharged at high-pressure state via the discharge port 151 of the stationary scroll 15. The isolating block 17 is fixed in a shell of the scroll compressor and partitions the shell into a high-pressure chamber 2 and a low-pressure chamber 3. A through hole 173 is disposed at the center of the isolating member 17 to connect the two chambers 2 and 3. The stationary scroll 15 is located in the low-pressure chamber 3. The projecting edge of the discharge port 151 at the back of the stationary scroll 15 forms a tubular neck 152. The neck 152 is lagged in the through hole 173 of the isolating block 17 and can make a little motion along the axis of the through hole 173. A sealing ring 155 of back pressure mechanism and a resilient member 156 are installed in the tubular neck 152. The sealing ring 155 presses on the resilient member 156 to build back pressure. An anti-leakage member 157 is installed between the outer surface of the sealing ring 155 and the inner surface of the neck 152 to prevent high-pressure working fluid of the discharge port from leaking into the low-pressure chamber 3. As shown in FIG. 1, narrower cross section forms on the isolating block such that the direction toward the stationary scroll of low-pressure side has larger direct back pressure. The method is to enlarge the diameter of the discharge port such that contact portion of the stationary scroll and the isolating block bears larger pressure. That is, pressure on the isolating block from the high-pressure chamber is larger enough to enhance back pressure. This can also be accomplished with the second embodiment mentioned below.

Figure 2:
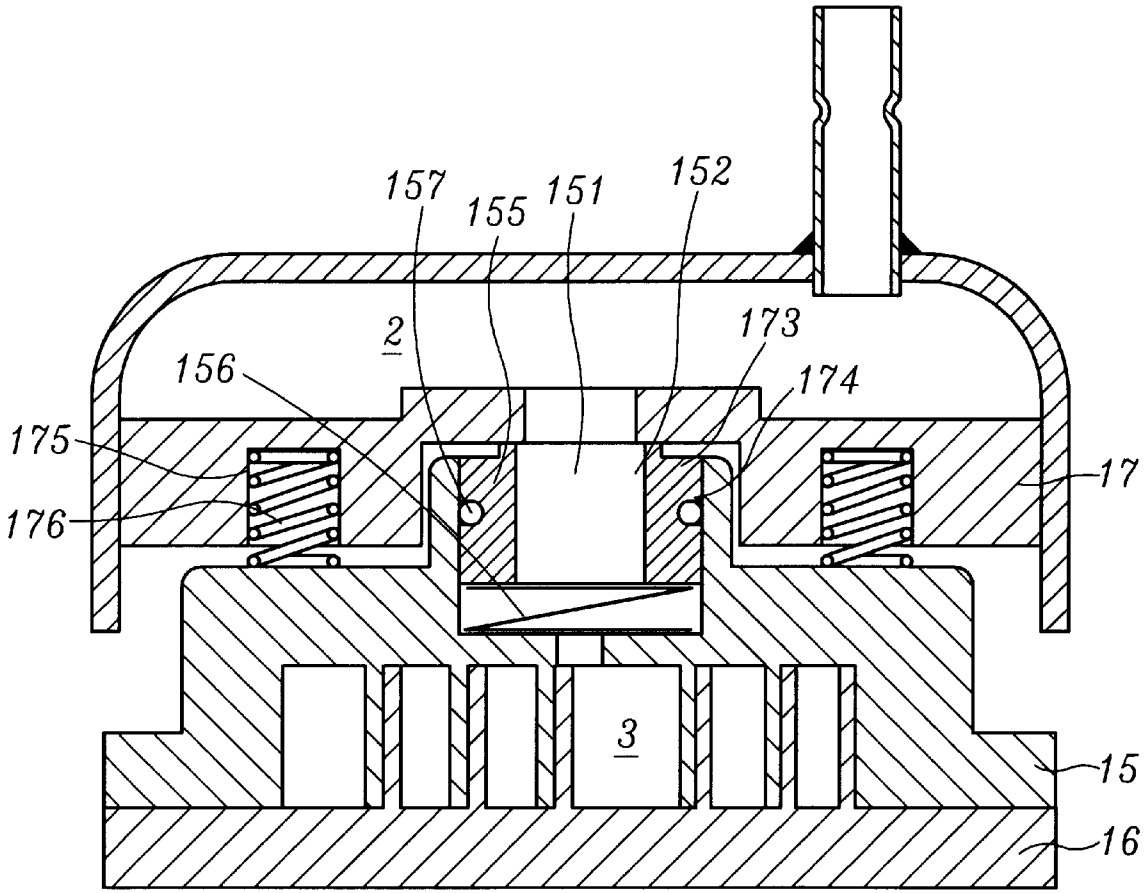
FIG. 2 is a cross-sectional view according to a second embodiment of the present invention (only the isolating block has a spring)
Figure 3:
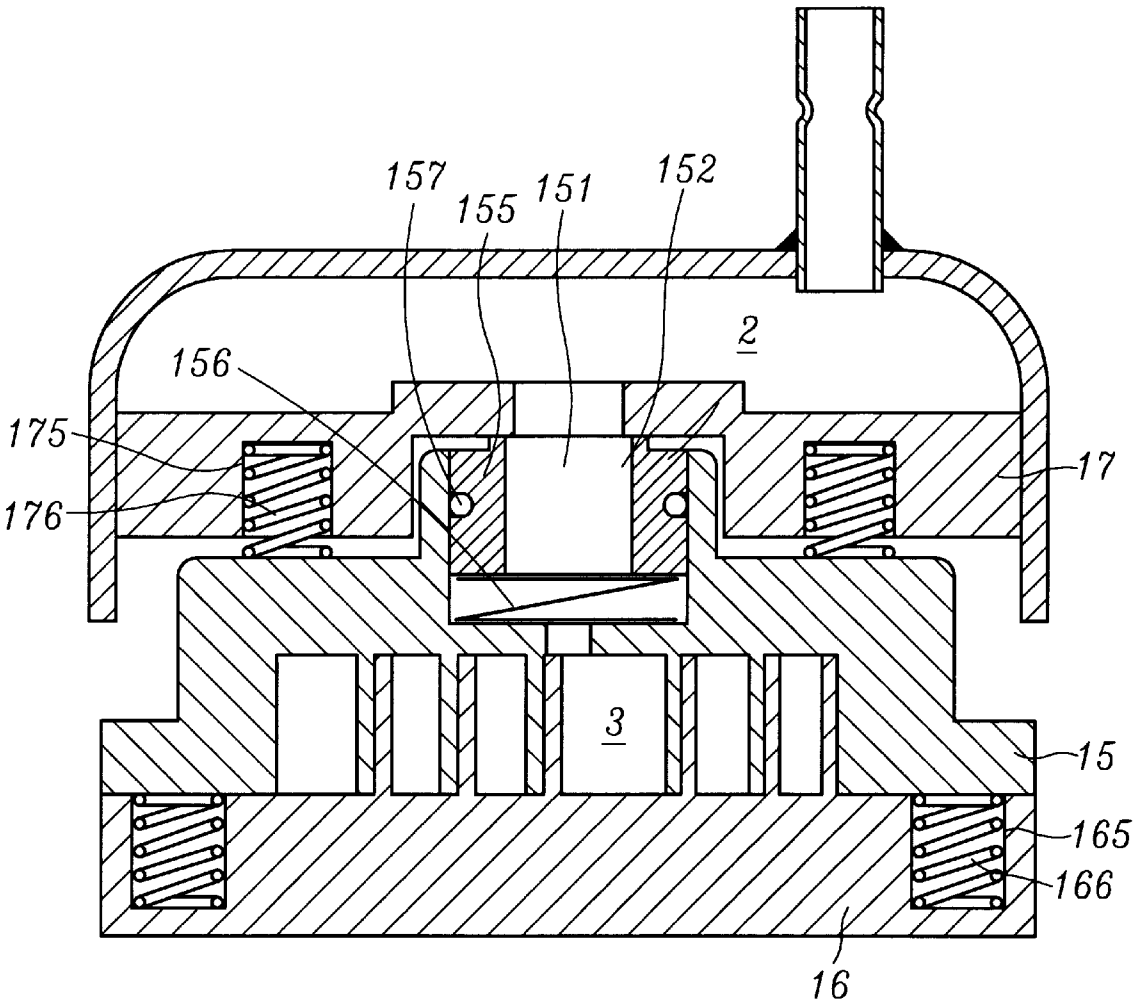
FIG. 3 is a cross-sectional view according to a second embodiment of the resent invention (another state)
Figure 4:
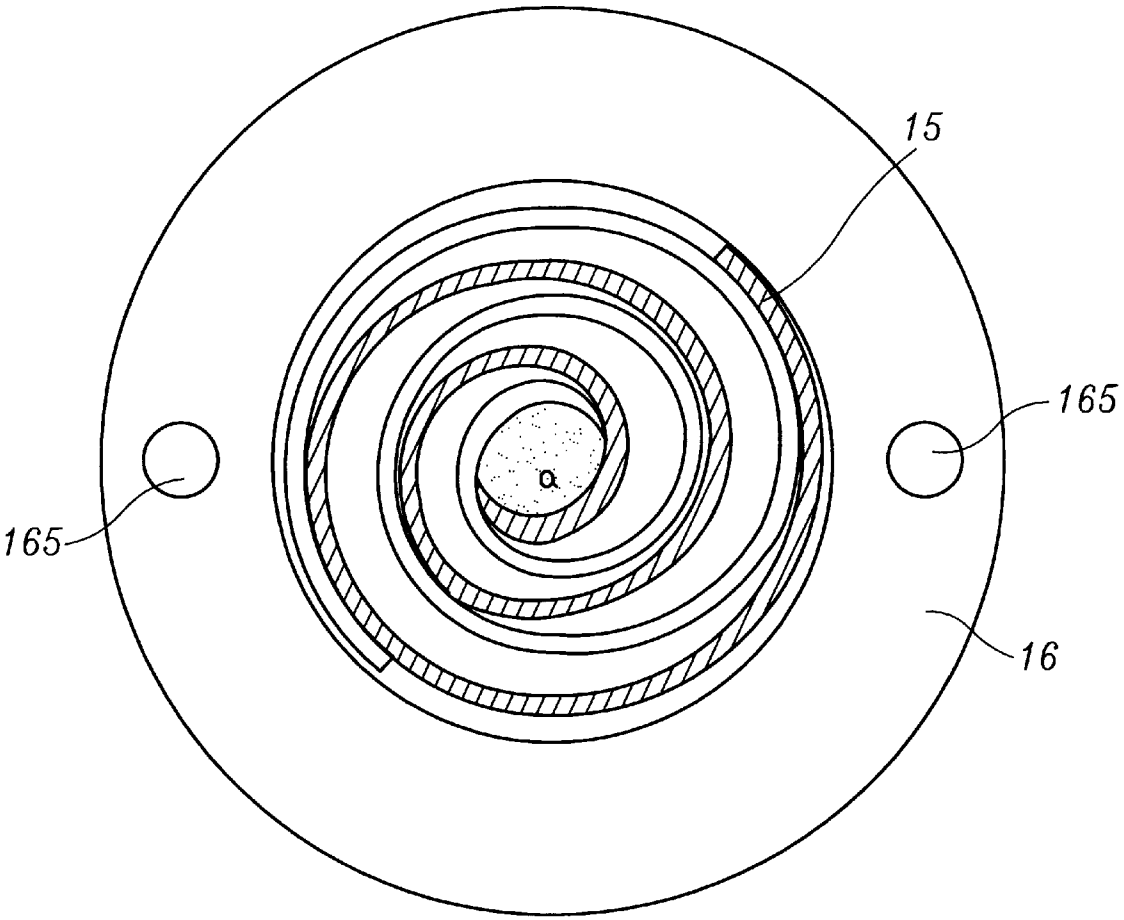
FIG. 4 is a top view of the orbiting scroll of the present invention.
Figure 5:
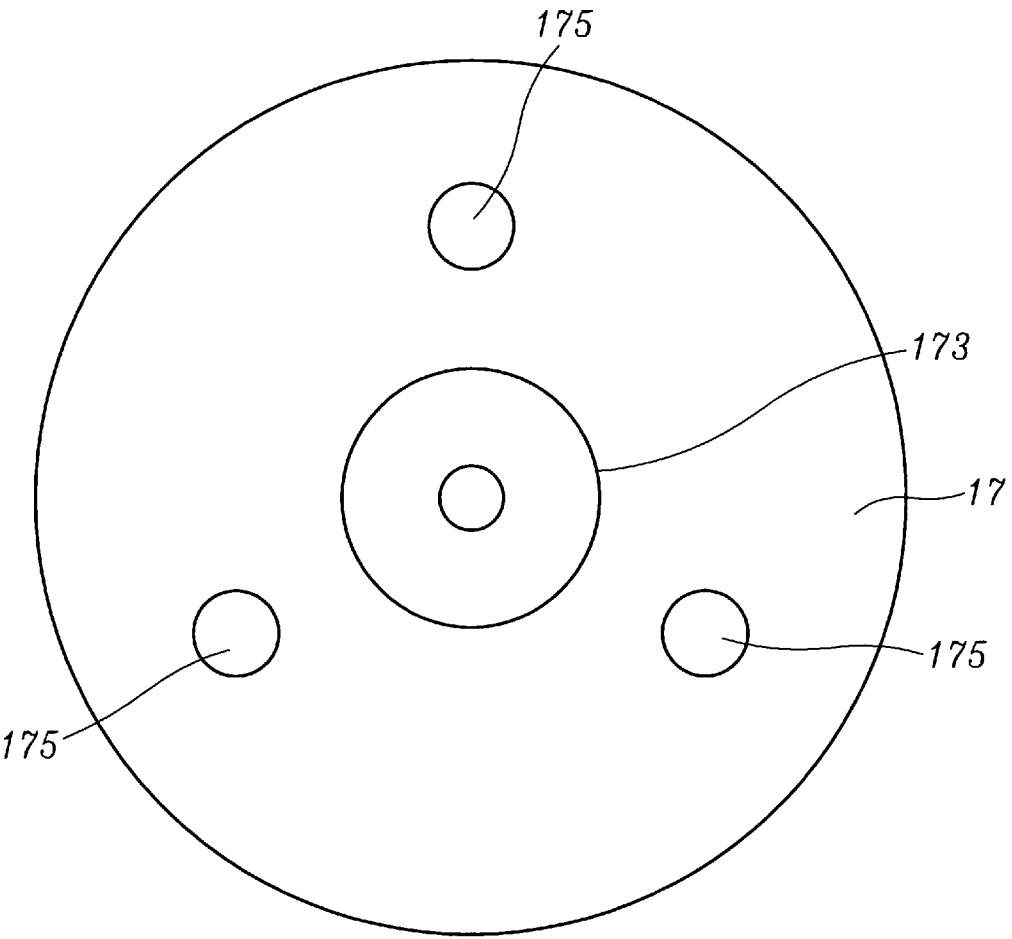
FIG. 5 is a bottom view of the isolating block of the present invention.
Figure 6B:
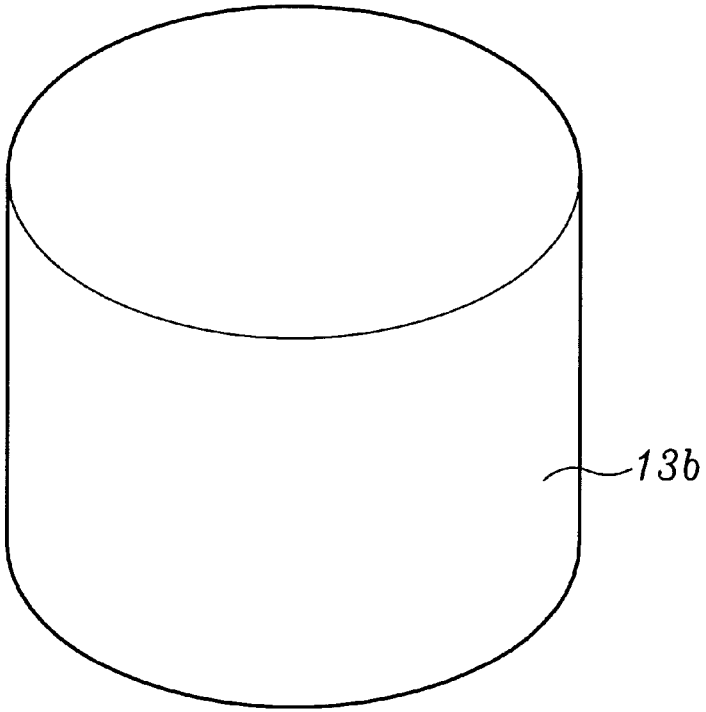
FIG.6b PRIOR ART
FIG. 6*b* is a perspective view of the pressing member (bolt of cylindrical shape) in prior art.
Figure 6A:
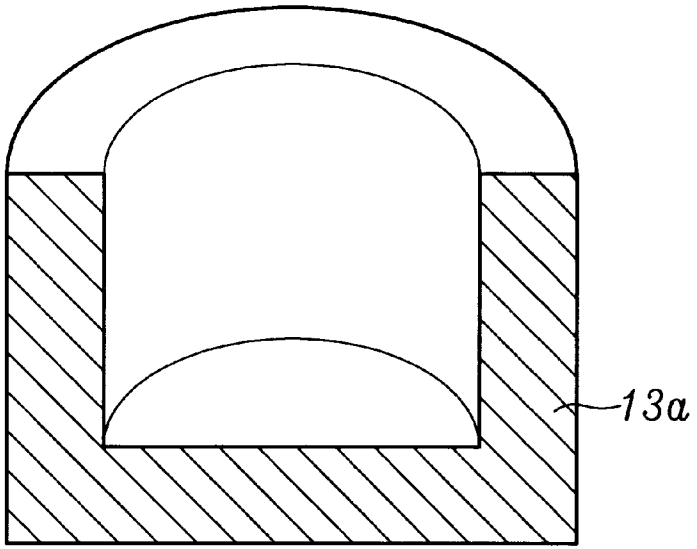
FIG.6a PRIOR ART
FIG. 6*a* is a perspective semi-cross-sectional view of the pressing member (bolt of cylindrical cup shape) in prior art.
Figure 7:
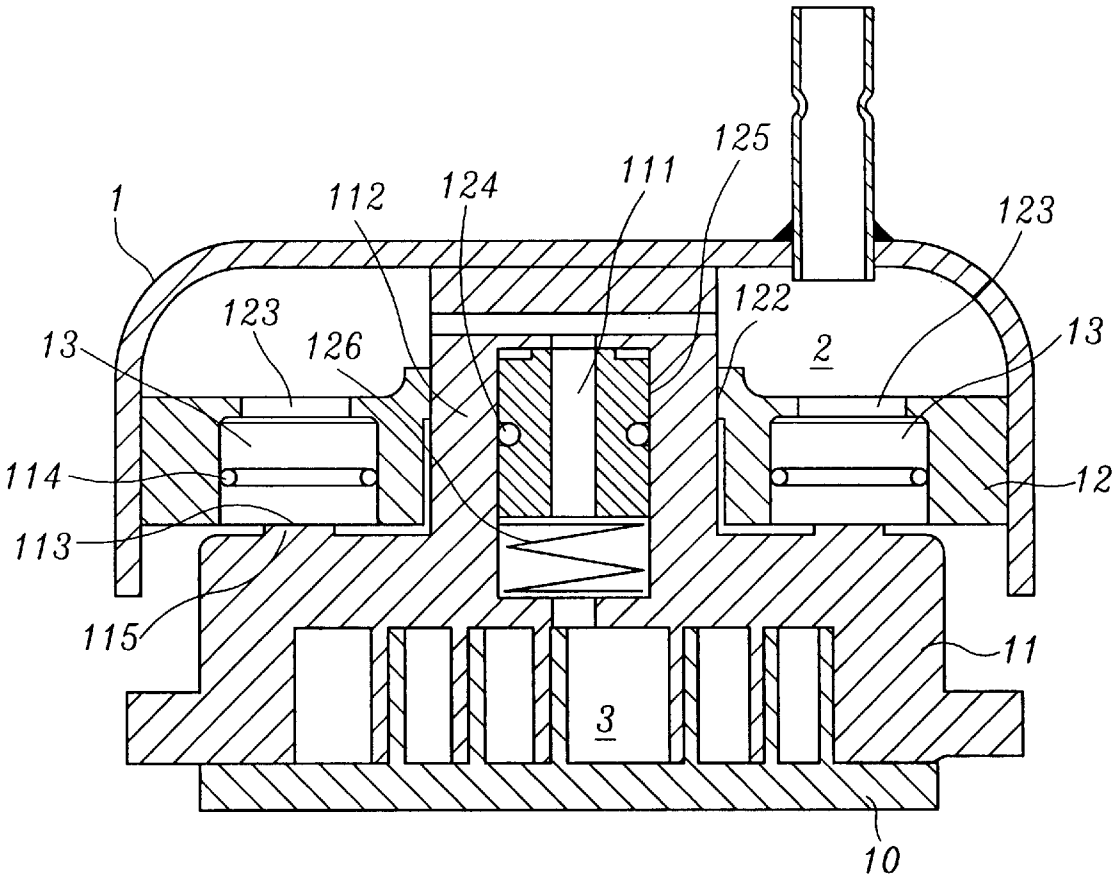
FIG. 7 PRIOR ART
FIG. 7 is a cross-sectional view of the pressing member (bolt) in prior art when used in a scroll compressor.
Figure 8A:
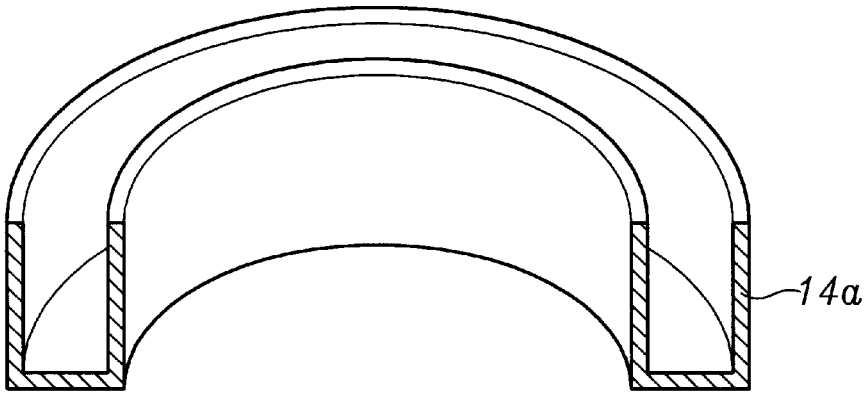
FIG.8a PRIOR ART
FIG. 8*a* is a perspective semi-cross-sectional view of the pressing member (annular groove shape) in prior art.
Figure 8B:
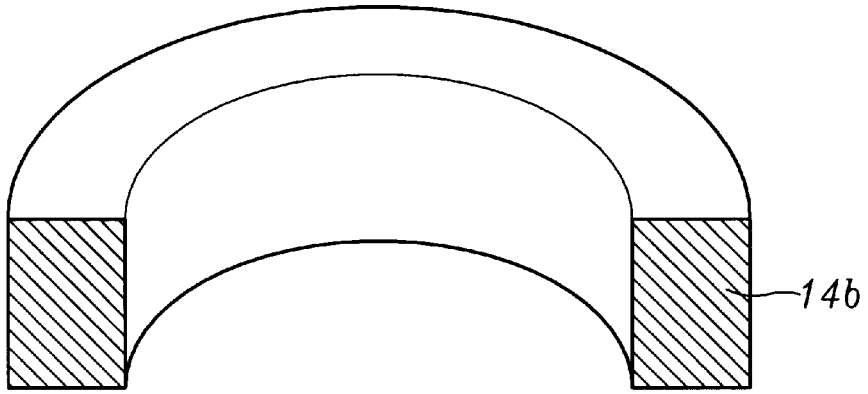
FIG.8b PRIOR ART
FIG. 8*b* is a perspective semi-cross-sectional view of the pressing member (annular shape) in prior art.
Figure 9:
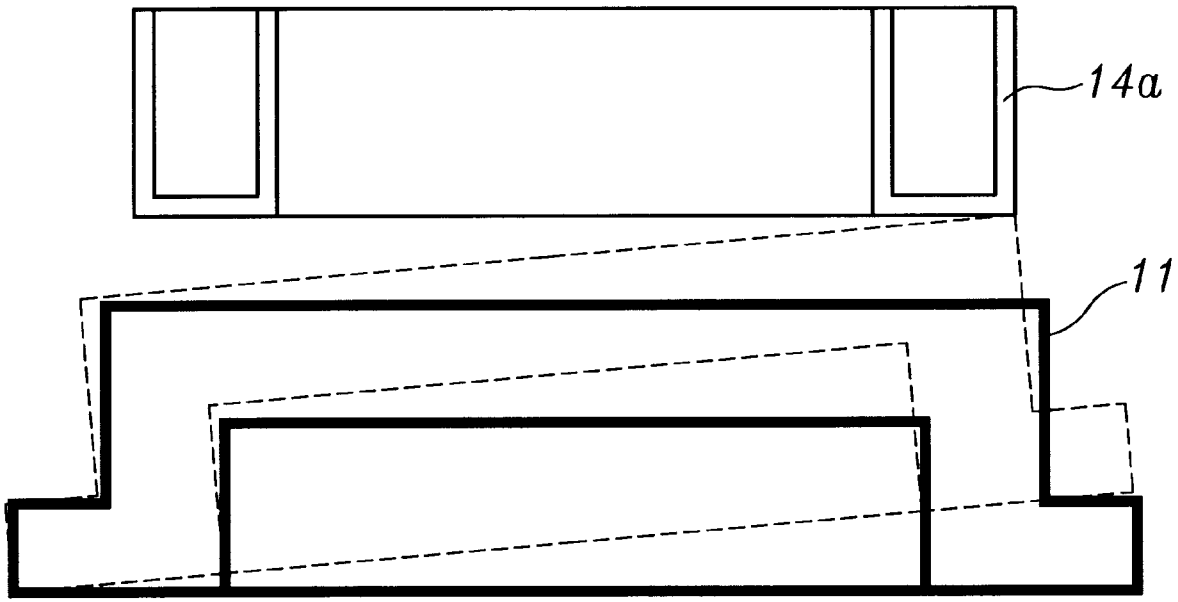
FIG.9 PRIOR ART
FIG. 9 is a diagram showing the pressing member (annular groove shape) in prior art when used in a scroll compressor.
Figure 10:
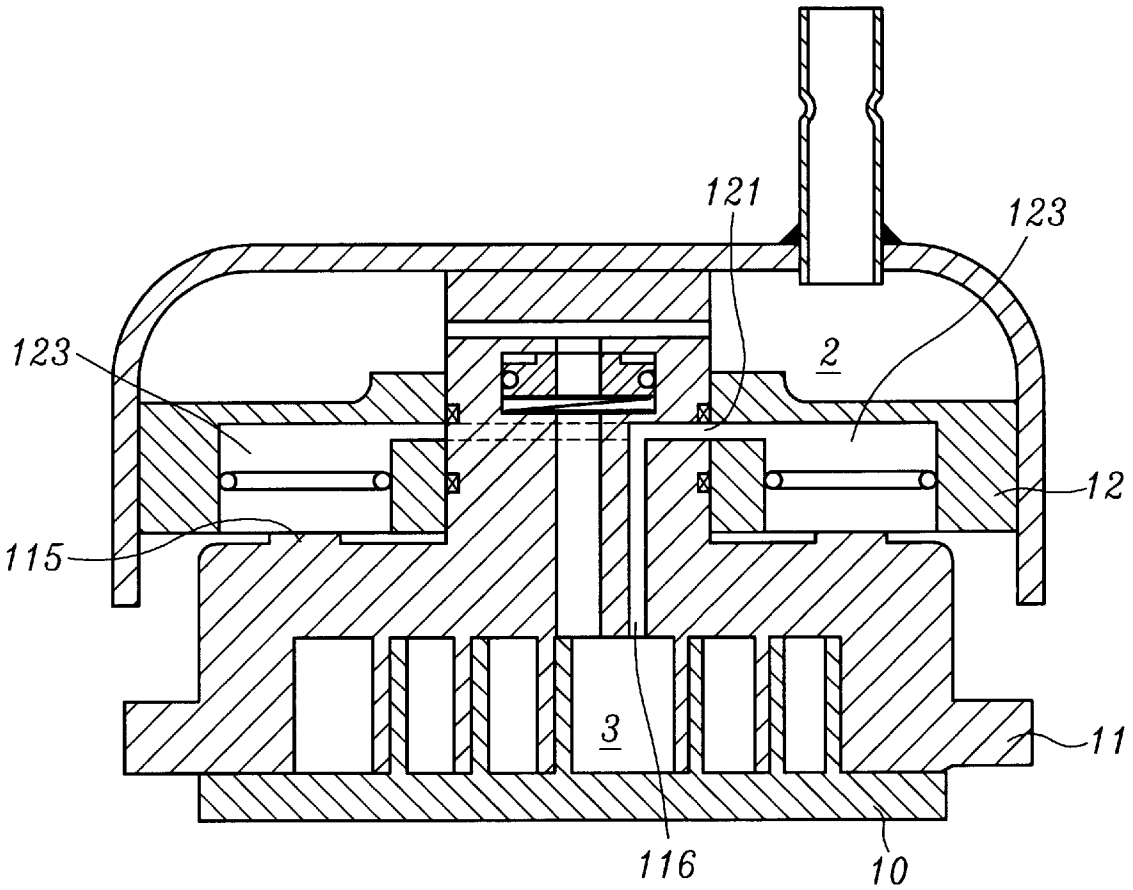
FIG. 10 PRIOR ART
FIG. 10 is a cross-sectional view of the pressing member according to an embodiment of prior art.

As shown in the second embodiment of FIG. 2, more than one balance rooms 175 are installed only at the positions toward the low-pressure chamber 3. A resilient member 176 is placed in the balance room 175. The resilient member 176 is lapped on the back of the stationary scroll 15. As shown in FIG. 3, more than one anti-pressure rooms 165 can also be installed on the orbiting scroll 16. A second resilient member 166 is placed in the anti-pressure room 165 to provide slightly larger pressure for the second resilient member 166 than pressure of the first resilient member 176 when the orbiting scroll 16 starts to rotate. There can be only a balance room of annular groove shape. There can also be two balance rooms spaced in half, but the stability is inferior. It is preferred that there are three balance rooms (as shown in FIG. 5) matched with three first resilient member. The first resilient member is generally a spring. There can be only an anti-pressure room of annular groove shape. It is preferred that there are two or more anti-pressure rooms (as shown in FIG. 4), each matched with a second resilient member. The second resilient member is generally a spring. A more preferable installation method is similar to that shown in FIG. 3. The anti-pressure room and the balance room are disposed at corresponding positions such that the stationary scroll sticks tightly to the orbiting scroll. The two scrolls are tightly joined in axial direction to prevent compressed working fluid of each compression room from leaking out. Especially when the scroll compressor starts, the orbiting scroll will shift to let the stationary scroll swing. Noise and abrasion are thus generated. If the resilient members are installed, damping effect of the springs will result in balance action. Because no fluid of high pressure and low pressure is generated at this time, no back pressure can be exploited to let the resiliency of the second resilient members be larger than that of the first resilient member. When the orbiting scroll starts, it will not suffer large pressure from the stationary scroll. Static friction is reduced such that the orbiting scroll can start smoothly and silently and be pressed and supported immediately by the stationary scroll, resulting in plane balance. Therefore, no swing will arise.

To sum up, the present invention provides resilient members placed in the balance room of the isolating block and in the anti-pressure room to generate soft pressing and supporting function. Three back pressure holes with large diameter drilled at positions at the same distance from the center on the top surface of the isolating block can thus be omitted. Alternatively, three small holes replace the three back pressure holes. The number of the small holes is not restricted to three. It is not necessary to guide high-pressure working fluid into the back pressure room. A universal resilient member is matched to press and support relevant positions. This different design having both resilient and non-penetrating effects can save manufacturing time of the pressing member in prior art and installation of anti-leakage members, resulting in reduction of assembly time and number of required components. Because non-metallic member is used to press the stationary scroll, impact noise resulted from a little motion between non-metallic member and the stationary scroll can be greatly reduced. Also, the projecting ring needed to be installed on the back of the stationary scroll in prior art is saved, reducing production process and time. The present invention substantially improves the isolating block while reducing production cost. Also, the stability of the stationary scroll is better than that in prior art. Moreover, the orbiting scroll can start to rotate more conveniently. Therefore, the present invention is a very practical design.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A balance structure of an axial submission device for a scroll compressor comprising:

a stationary scroll having a discharge port centrally formed in a back side thereof;

an orbiting scroll axially coupled to said stationary scroll;

an isolating block fixed in a shell of the scroll compressor and abutting said back side of said stationary scroll for partitioning high pressure from low pressure in said scroll compressor, said isolating block having (a) a centrally disposed through hole formed therein in open communication with said discharge port, and (b) at least three balance rooms disposed in equidistantly spaced relationship one with respect the others adjacent said back side of said stationary scroll; and, at least three resilient members respectively disposed in said at least three balance rooms, each of said at least three resilient members being lapped on said back side of said stationary scroll.

* * * * *